US006761472B1

(12) United States Patent
Cleaver et al.

(10) Patent No.: US 6,761,472 B1
(45) Date of Patent: Jul. 13, 2004

(54) WATER SUBMERGIBLE SIMULATED NEON LIGHTING DEVICE

(75) Inventors: Mark J. Cleaver, Wilmette, IL (US); Eric Olav Eriksson, Evanston, IL (US); George R. Hulse, Cookeville, TN (US)

(73) Assignee: iLight Technologies, Inc., Evanston, IL (US)

( * ) Notice: Subject to any disclaimer, the term of this patent is extended or adjusted under 35 U.S.C. 154(b) by 0 days.

(21) Appl. No.: 10/198,432

(22) Filed: Jul. 16, 2002

Related U.S. Application Data

(63) Continuation-in-part of application No. 09/982,705, filed on Oct. 18, 2001, now Pat. No. 6,592,238.

(51) Int. Cl.[7] ..... F21V 29/00

(52) U.S. Cl. ..... 362/267; 362/219; 362/555; 362/235

(58) Field of Search ..... 362/555, 267, 362/310, 249, 233, 31, 103, 108, 806, 551, 219

(56) References Cited

U.S. PATENT DOCUMENTS

| | | | |
|---|---|---|---|
| 4,607,317 | A | 8/1986 | Lin |
| 5,057,981 | A | 10/1991 | Bowen et al. |
| 5,879,076 | A | 3/1999 | Cross |
| 5,964,981 | A | 10/1999 | Nelson et al. |
| 6,146,006 | A | 11/2000 | Cross |
| 6,158,882 | A | 12/2000 | Bischoff, Jr. |
| 6,193,385 | B1 | 2/2001 | Maki et al. |
| 6,217,201 | B1 | 4/2001 | Hulse |
| 6,244,734 | B1 | 6/2001 | Hulse |
| 6,260,991 | B1 | 7/2001 | Hulse |
| 6,431,717 | B1 | 8/2002 | Anderson et al. |

*Primary Examiner*—Thomas M. Sember
(74) *Attorney, Agent, or Firm*—Stites & Harbison, PLLC; David W. Nagle, Jr.; Vance A. Smith

(57) ABSTRACT

A waterproof illumination device for simulating the lighting effect of neon lighting with the additional feature of being unaffected by water submersion. The device comprises a plurality of space point light sources secured within a waveguide that is waterproofed by sealing.

10 Claims, 5 Drawing Sheets

WATER SUBMERGIBLE SIMULATED NEON LIGHTING DEVICE

CROSS-REFERENCE TO RELATED APPLICATIONS

This application is a continuation-in-part of U.S. utility patent application Ser. No. 09/982,705 filed Oct. 18, 2001, now U.S. Pat. No. 6,592,238 entitled Illuminating Device for Simulating Neon Lighting, the entire disclosure of which is incorporated herein by reference.

BACKGROUND OF THE INVENTION

The present invention relates to waterproof illumination devices using optical waveguide and, more particularly, to lighting devices for the simulation of neon lighting using optical waveguides and high intensity low voltage light sources, ideally adapted for use within an aqueous environment unsuitable for normal neon lighting devices Neon lighting which is produced by the electrical stimulation of the electrons in the low pressure neon gas filled glass tube has been a main stay in advertising and for outlining channel letters and building structures for many years. A characteristic of neon lighting is that the tubing encompassing the gas has an even glow over its entire length irrespective of the viewing angle. This characteristic makes neon lighting adaptable for many advertising applications including script writing and designs because the glass tubing can be fabricated into curved and twisted configurations simulating script writing and intricate designs. The even glow of neon lighting being typically devoid of hot spots allows for advertising without visual and unsightly distractions. Thus, any illumination device that is developed to duplicate the effects of neon lighting must also have even light distribution over its length and about its circumference. Equally important, such lighting devices must have a brightness that is at least comparable to neon lighting. Further, since neon lighting is a well established industry, a competitive lighting device must be light in weight and have superior "handleability" characteristics in order to make inroads into the neon lighting market.

Neon lighting is recognized as being fragile in nature. Because of the fragility and heavy weight primarily due to its supporting infrastructure, neon lighting is expensive to package and ship. Moreover, it is extremely awkward to initially handle, install, and/or replace. Any lighting device that can provide those previously enumerated positive characteristics of neon lighting while minimizing its size, weight, and handleability shortcomings will provide for a significant advance in the lighting technology. Traditional neon is particularly not suited for use within an aqueous environment. If moisture penetrates the structure of a traditional neon lighting, it will impair the contact points of the electrical accessories and will result in electrical shortage and damages. Waterproofing neon lighting devices to prevent such problems typically require encapsulating the entire neon lighting device in a waterproof envelope, such as an acrylic. This adds considerable bulk to the neon device and increases the manufacturing expense.

U.S. Pat. No. 4,891,896 issued on Jan. 9, 1990 to Boren and assigned to the Gulf Development Company is an example of many attempts to duplicate neon lighting. Like this attempt, most prior art neon simulations have resulted in structures difficult to fabricate and providing a little in the way of weight and handling benefits. The Boren patent exemplifies this by providing a plastic panel with essentially bas-relief lettering. The material comprising the lettering is transparent and coated with a translucent material. The surrounding material is opaque. When the panel is back lit, the lettering tends to glow with a neon-like intensity.

It is therefore a paramount object of the present invention is to provide for an energy efficient, virtually unbreakable alternative to neon lighting capable of being submerged in an aqueous environment.

Additional objects of the invention will become readily apparent and addressed through a reading of the discussion below and appended drawings.

SUMMARY OF THE PRESENT INVENTION

The present invention is an illumination device for simulating the lighting effect of neon lighting that is unaffected by water submersion. The device comprises a plurality of spaced point light sources secured within a waveguide and housing waterproofed by sealing. In a preferred embodiment, the device is a profiled and sealed rod with an enclosed lighting source of a string of point light sources spaced a distance apart sufficient to permit the mapping of the light emitted by each point light source into the rod. The point lighting sources and electrical leads connected to the lighting sources are encased in a waterproof sealing or potting compound essentially transparent to the light emitted by the light sources.

DETAILED DESCRIPTION OF THE INVENTION

Figure 1:
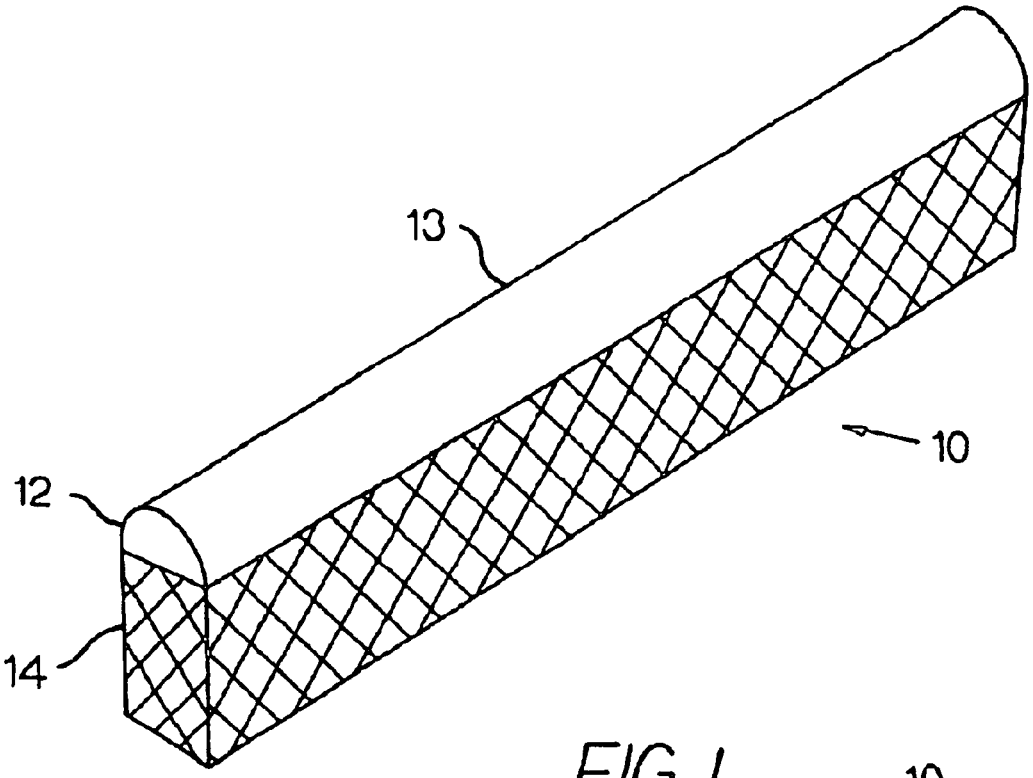
FIG. 1 is an elevated perspective view of an illumination device of the present invention.

To provide the desired result, i.e., an illumination device that is an effective simulator of neon lighting, it is important that the proper materials be selected for the component parts and those parts appropriately and geometrically positioned so that the resulting illumination device has an essentially uniform light intensity distribution pattern over the entire surface with the maximum obtainable brightness. To accomplish this, it is necessary to use a high intensity but dimensionally small light source together with an element that acts both as an optical waveguide and light scattering member, but permits light to exit laterally out of its surface (a "leaky waveguide"). By placing the light source contiguous such a leaky waveguide in a specific manner so as to cause the waveguide to uniformly glow over its lateral surface while maximizing the amount of light exiting the surface, applicants are able to obtain an illumination device that rivals or surpasses the uniform glow of neon tubing. There are many light sources which have a high light intensity output similar or equal to neon, but most are dimensionally too big to be practical, are fragile, or consume too much energy. It has been further observed that the best light source would likely have a small diameter that provided a uniform light output over an extended length. However, such a light source has not yet been developed to the technological state providing the intensity needed. Thus, applicants have determined that the best available light source for the purpose here intended is a string or strings of contiguously mounted, essentially point light sources such as spaced apart high intensity LEDs.

The ultimate objective of the illumination device of the present invention is to simulate an illuminated neon tube that glows with the proper intensity and uniformity over its length. Thus, applicants have determined that it is important that the leaky waveguide (used to simulate the neon tube) be comprised of a profiled rod of material having sufficient diffusivity that collectively with the other components of the invention visually eliminates any recognizable individual light distribution light pattern that originates from a respective LED or other light source. As stated above, the profiled waveguide preferentially scatters light along its length, but ultimately allows light to exit through its lateral surfaces.

Such a waveguide provides a visible elongated or oval-like light pattern for each LED, brightest at the center and diminishing continuously out from the center along the major and minor axis of the pattern. By spacing the LEDs a certain distance apart and each LED an appropriate distance from the exposed and lateral far side of the leaky waveguide, the light intensity distribution patterns on the surface of far side of the leaky waveguide are caused to overlap to such an extent that the variations in the patterns are evened out. This causes the collective light pattern on the lateral surface to appear to an observer to have an uniform intensity along the length of the waveguide. Other components of the illumination device of the present invention including, for example, the shape of the light sources may assist in establishing the required brightness and uniformity.

Figure 2:
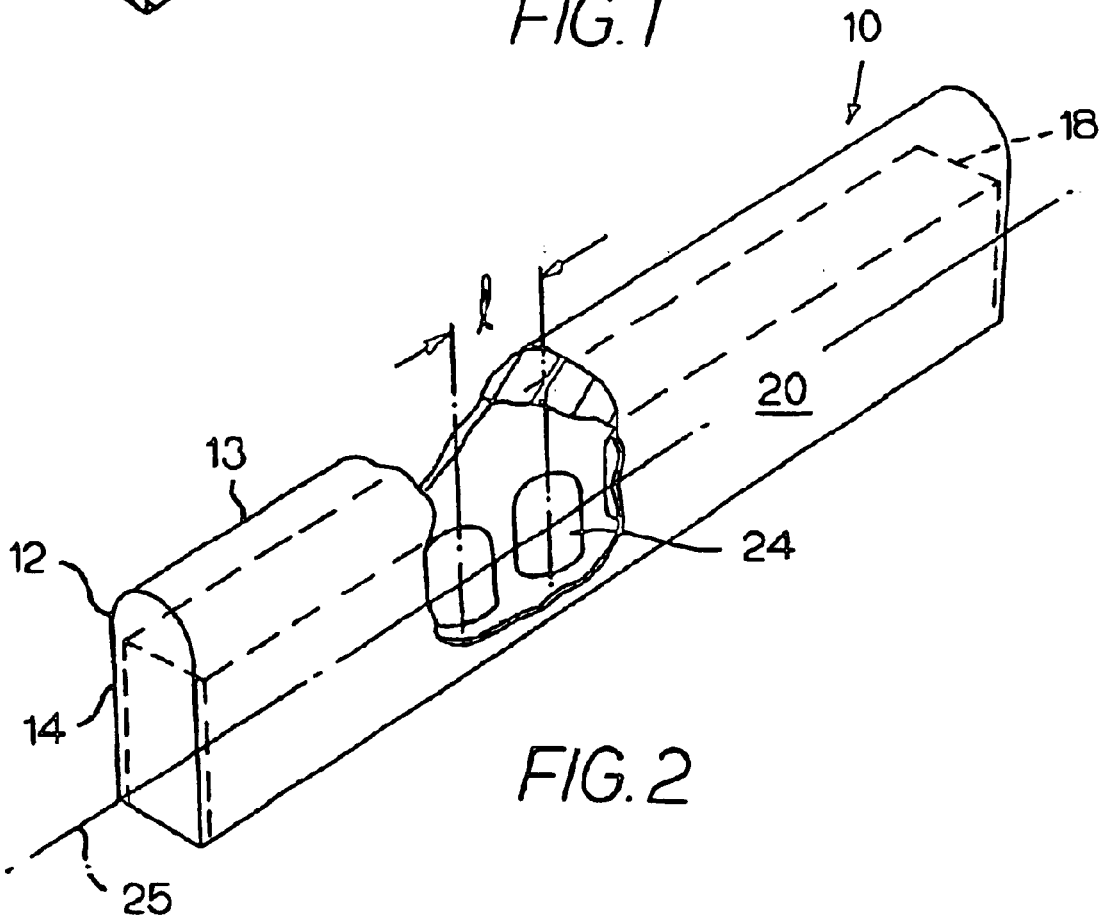
FIG. 2 is a perspective similar to that of FIG. 1 with a portion broken away to show the interior.
Figure 3:
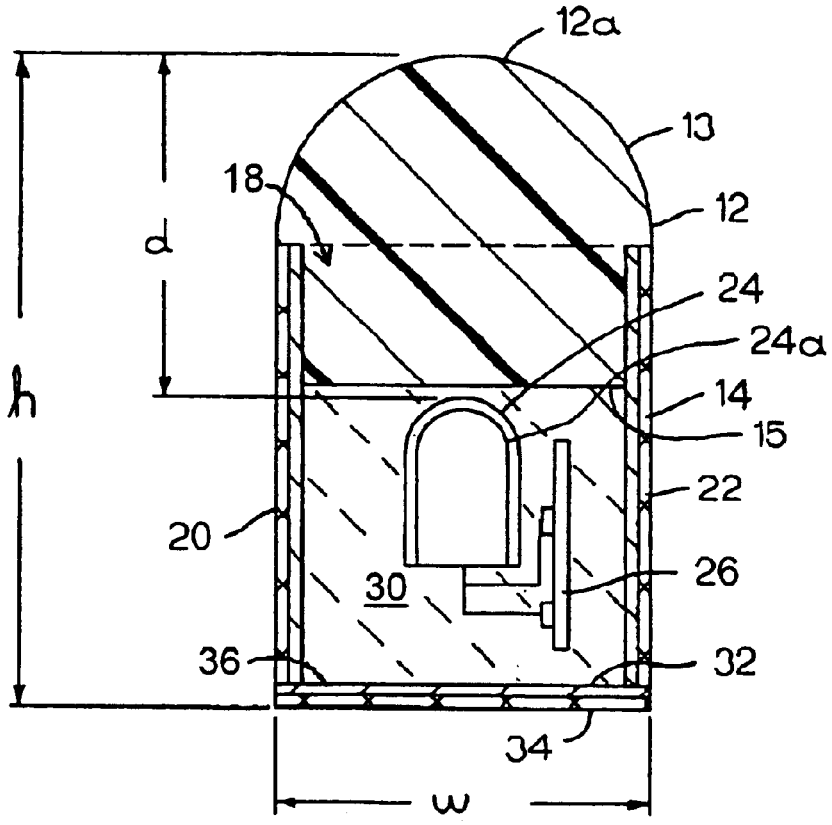
FIG. 3 is an expanded side view of the illumination device as shown in FIG. 1.

Structurally, the preferred embodiment of the present invention is portrayed in FIGS. 1–3 and shown generally as character numeral 10. The device 10 may be considered as having two major body components. The first component is a waveguide 12 having an exposed curved lateral surface 13 serving as the light emitting surface and a hidden lateral surface 15 (best seen in FIG. 3) that serves as the light receiving surface. Waveguide 12 is the aforementioned leaky waveguide and surface 13 serves as the counterpart to the neon tube. That is, the light laterally entering the waveguide from a light source juxtaposed to the surface 15 is preferentially scattered so as to exit with a broad elongated light intensity distribution pattern out of surface 13. Visually, the waveguide 12, when not illuminated internally, has a milky appearance due to the uniform scattering of ambient light that enters the waveguide and that ultimately exits the lateral surface thereof.

Applicants have found that acrylic material appropriately treated to scatter light and to have high impact resistant to be the preferred material for use in forming the waveguide components of the present invention. When shaped into the profiled rods, the rods take on the desired leaky waveguide characteristics. Moreover, such material is easily molded or extruded into rods having the desired shape for whatever illumination application may be desired, is extremely light in weight, and withstands rough shipping and handling. While acrylic material having the desired characteristics is commonly available, it can be obtained, for example, from AtoHass, Philadelphia, Pa. under order number DR66080. When shaped into a rod, such acrylic material is observed to have the leaky waveguide characteristics desired. Other materials such as such as beaded blasted acrylic or polycarbonate provided with the desired preferential light scattering characteristics may be used as well for other applications.

Figure 3A:
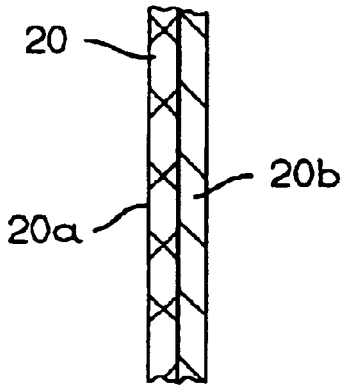
FIG. 3A is an enlarged wall segment of the illumination device shown in FIG. 3.

The second component of the present invention is a housing 14 positioned adjacent the a lateral light receiving surface 15 of the waveguide 12. The housing 14 comprises a pair of side walls 20, 22 abutting and downwardly extending from the lateral light emitting surface 13 and defining an open ended channel 18 that extends substantially the length of waveguide 12. The housing 14 generally functions to house the light source and electrical accessories and to collect light not emitted directly into surface 15 and redirect it to the waveguide. In other words, the housing 14 further serves to increase the light collection efficiency by directing by reflection the light incident upon the internal surfaces of the housing 14 into the waveguide 12 and assist in the scattering of the light. From a viewer's perspective, it is desirable that the visual appearance of the housing 14 not be obtrusive with respect to the glowing surface 13 of the waveguide 12; thus, it is preferred that the outside surface 13 of the housing 14 be light absorbing and thus visually dark to an observer. Again, it is preferred that the housing 14 also be made from an impact resistant acrylic material with the outer surface walls 20, 22 having an outer regions formed from a dark pigmented, thus light absorbing, acrylic while the inner regions are made from a white pigmented, thus light reflecting, acrylic. The two regions are best viewed in FIG. 3A show an enlarged segment of wall 20 in which the outer region 20*a* is the dark acrylic and the inner region 20*b* is the white acrylic. Such acrylic materials preferably are the same as used for the waveguide. While the waveguide 12 and housing 14 may be separately formed and then appropriately joined, it is preferred that the components be molded or extruded as a unit in long sections with the channel 18 already formed. The individual sections can be easily shaped into the desired configurations with the channel 18 actually aiding in the bending of the housing 14.

Figure 3B:
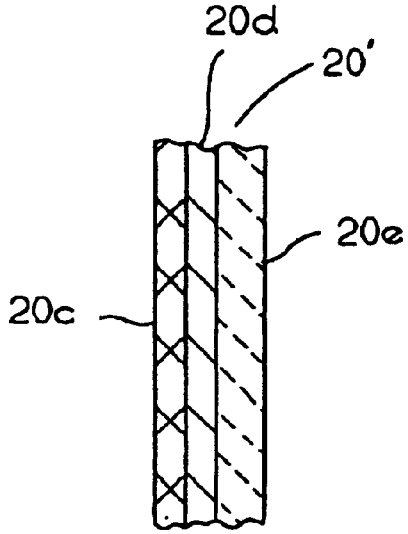
FIG. 3B is an enlarged wall segment like that shown in FIG. 3A with a variation in its structure.
Figure 4:
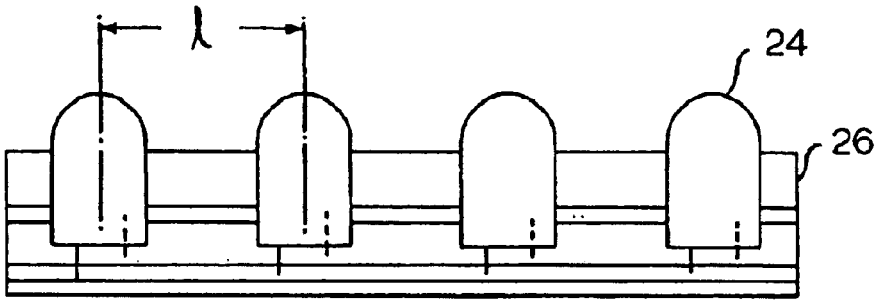
FIGS. 4–6 are respective front, side, and top elevation views of the diodes connected to an electrical board as used in the present invention.
Figure 5:
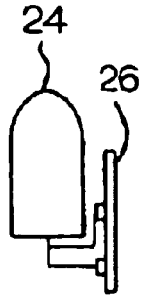
Figure 5A:
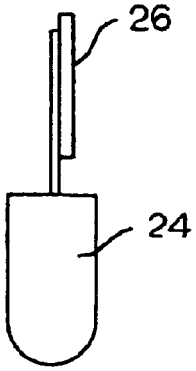
Figure 5B:
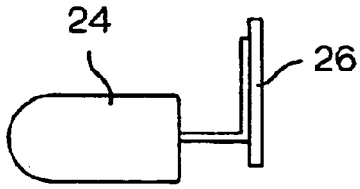

An alternate wall structure is shown in FIG. 3B in which the wall 20' has three components, an outer dark region 20*c*, and intermediate light reflecting 20*d*, and a transparent wall 20*e*. The outer and intermediate regions 20*c* and 20*d* could be dark and white coatings painted on the wall 20 which itself may be comprised of a transparent acrylic material.

Although the above discussion sets forth a preferred construction of the housing, it should be understood that in some applications the reflecting and absorption characteristics may be provided by light reflecting and absorption paint or tape. Additionally, there may be little concern about the visibility of the housing 14. In such instances it may not be necessary to provide the light reflecting and/or absorption characteristics to the outer surface of the side walls 20, 22.

It is important that the potting compound 30 (shown in FIG. 3) used to fill channel 18 have the desired light transmitting characteristics and be effective in maintaining the positioning of both the LEDs 24 and the board 26, and protecting the LEDs 24 from water penetration. Moreover, as the illumination device 10 of the present invention has application in a submerged environment, the potting compound 30 provides the necessary waterproofing to the LEDs 24 and associated electrical member connections. Further, it is preferable that the potting compound 30 harden into an impact resistant material having an index of refraction essentially matching that of the housing 24*a* of the LEDs 24 to minimize Fresnel losses at the interface there between. The potting compound 30 further adds strength to the structure by filling in the channel 18 and assists in reducing hot spots from forming on the lateral surface 13. As is also seen in FIG. 3, the bottom surface 36 of the device 10 may be covered with a light reflecting surface 32 which may be, for example, a white potting compound and this optionally covered with a light absorbing material 34.

The intensity of the point light sources preferably used by the present invention are typically sufficient to provide the requisite brightness. It bears repeating that the quintessentially feature of the present invention, however, is the careful spreading or distribution of the individual light patterns of the point light sources such that the light patterns are preferentially expanded along the light emitting surface and form an oval-like light intensity pattern. Equally important is that the minor axis of the oval-like light intensity pattern extends substantially the entire circumferential width of the curved light emitting surface. The preferential spreading of each of the light intensity patterns along the waveguide also permits the overlapping of the individual light patterns. This in turn enables the present invention to provide an observed uniform collective light pattern along and over the entire light emitting surface.

There are various parameters that have an impact on both the brightness and uniformity of the light intensity pattern emitted by the surface 13 of the waveguide 12. Among the most important are the scattering characteristics of the waveguide material, the spacing "l" between LEDs 24 as shown in FIG. 2, the lensing effect of the LED housing 24*a*, the shape and structure of the housing 14, and the distance "d" (shown in FIG. 3) from the apex of the LED housing 24*a* along a line perpendicular to the axis of the waveguide 12 to the apex point 12*a* on the lateral surface 13. To promote uniformity of the light intensity distribution pattern on the surface 13 of the waveguide 12, a line of LEDs 24 must be positioned a predetermined distance "d" from apex point 12*a* of the waveguide. This string of LEDs 24 are electrically connected to and spaced along an elongated circuit board 26 within the housing 14. Positioning the LEDs 24 too close to the surface will cause a "hot spot", i.e., a region of higher light intensity to locally appear on the surface 12*a* of the waveguide and spoil the quality of the uniform glow. Placing in too far from surface 12*a* will clearly and undesirably diminish the overall light intensity emanating from the waveguide 12 and may also prevent the minor axis of the oval-like pattern from extending over the circumferential width of the light emitting surface. As an example only, it has been determined that when the curved surface has a radius of curvature of about ⅜ inch and a circumferential width of about 19 mm, the device 10 (shown in FIG. 3) has a height "h" of about 25 mm and a width "w" of about 9.5 mm, and the LEDs have a candle power of about 280 mcd and are spaced apart about 12 mm, the distance "d" should be about 17.75 to 17.80 mm.

Figure 7A:
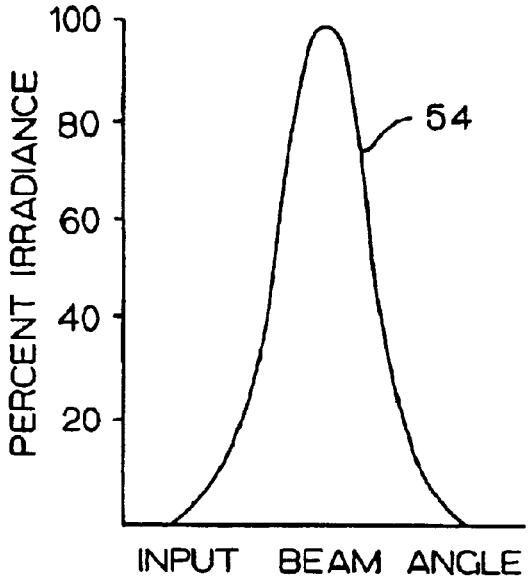
FIGS. 7A and 7B show, respectively, a graph illustrating the light distribution characteristics of a single point light source and a schematic of the device used to measure the same.
Figure 7B:
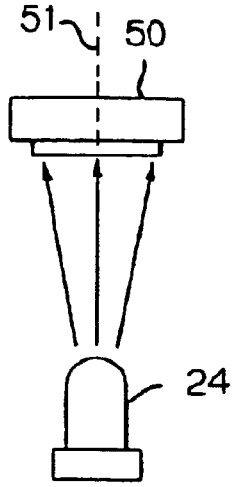
Figure 7D:
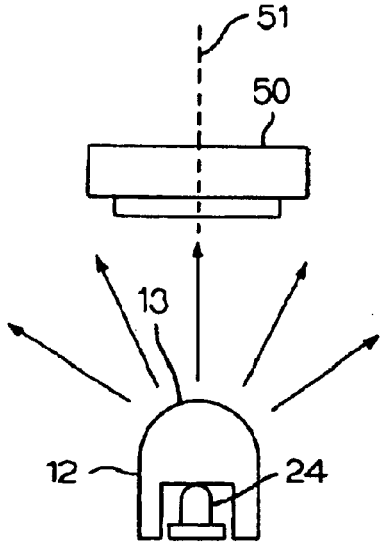
FIGS. 7C and 7D show, respectively, a graph illustrating the light distribution characteristics of a single point light source mounted within a device constructed in accordance with the present invention and a schematic of the device used to measure the same.
Figure 7C:
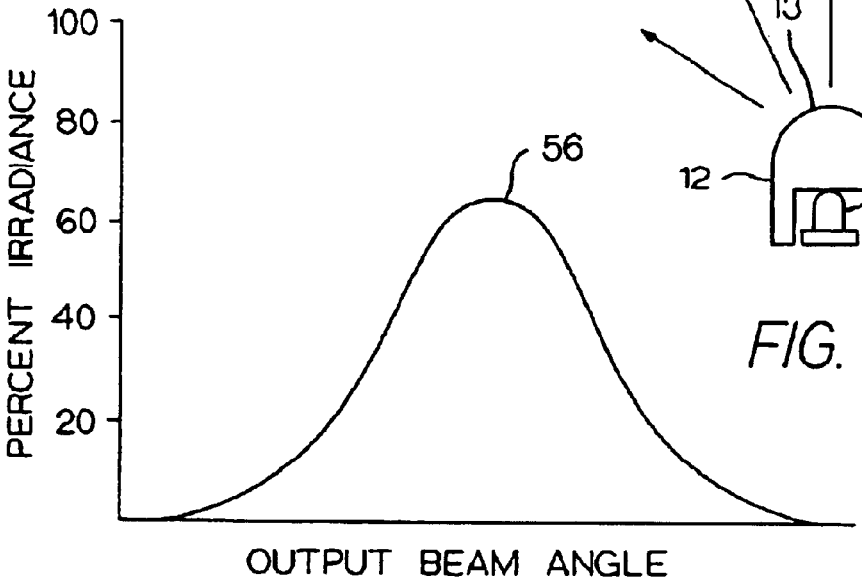

To better understand the principal under which the present invention operates, reference is now made to FIGS. 7A–7F. A single LED or point light source provides a narrow light intensity pattern 54 as graphically portrayed by FIG. 7A. Such a graph can be generated by using a photocell type of device 50 portrayed in FIG. 7B and progressively measuring the light intensity at various angles from the center line 51. This light pattern 54 should be contrasted to the one in FIG. 7C in which the pattern 56 is considerably broader with a concomitant reduction in the intensity along the center line 51. FIG. 7C represents the broad pattern emitted by the lateral surface 13 of the waveguide 12 constructed in accordance with the present invention.

Figure 7E:
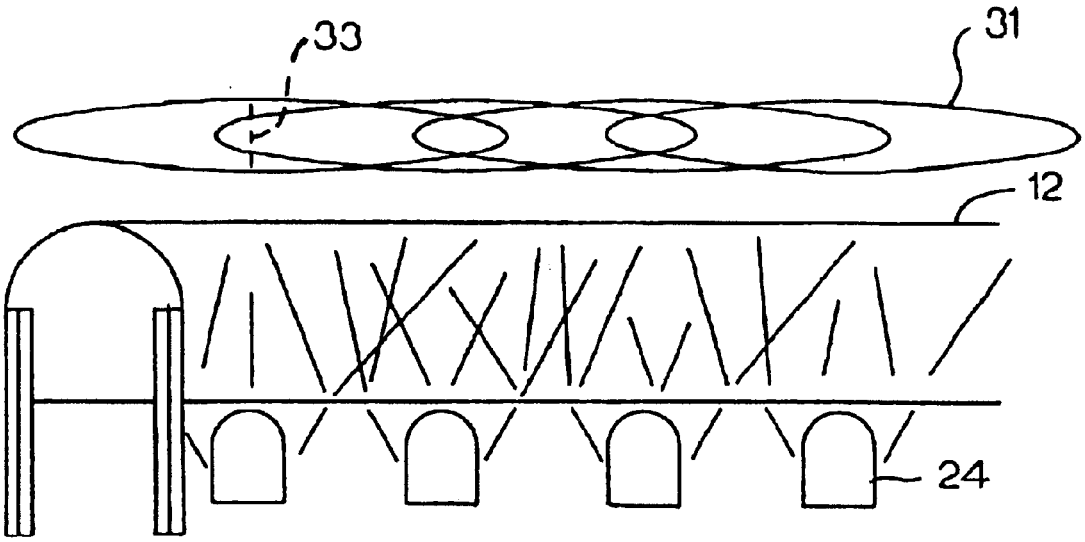
FIGS. 7E and 7F show, respectively, a Mercator-like top projection and a side schematic of the illuminated lateral surface of the waveguide with overlapping individual light distribution patterns.
Figure 7F:
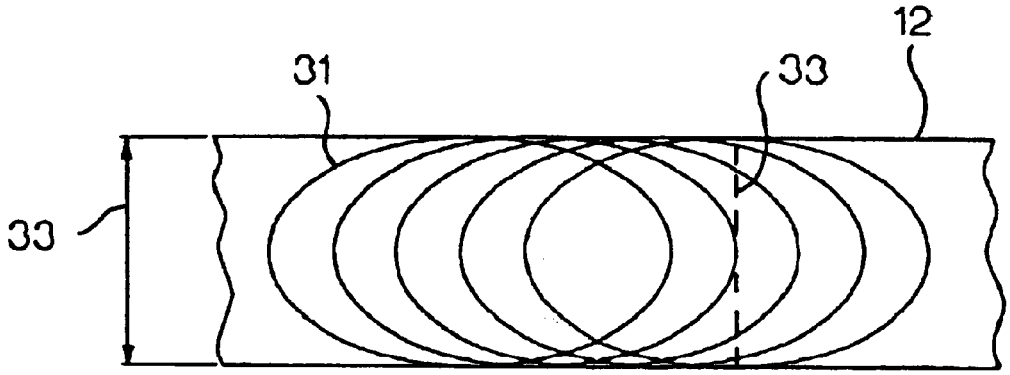

As stated above, it is important that the distance "d" and the LED spaced apart distance "l" be such that the oval-like intensity patterns of the individual LEDs overlap as portrayed in the schematic representation of FIG. 7E and the projection depicted in FIG. 7F schematically represents a plurality of LEDs 24 providing an broadened overlapping elliptical-like light intensity patterns 31 on the lateral surface 13 of the waveguide 12. FIG. 7D is top view using a Mercator-like projection of the light pattern areas 24 on the lateral surface. 13. The minor axis of the light intensity patterns 31 are represented by arrow 33. As stated above, for any given dimension of the waveguide and spacing of the point light sources, it is important that the distance "d" be appropriately set so distance so that the minor axis of the light intensity distribution pattern extends substantially the entire circumferential width of the curved lateral light emitting surface 13. For purposes of this disclosure the light intensity distribution pattern can be defined as the visible area of the light pattern extending out from the center region of the area that is visible discernible by an observer.

Figure 6:
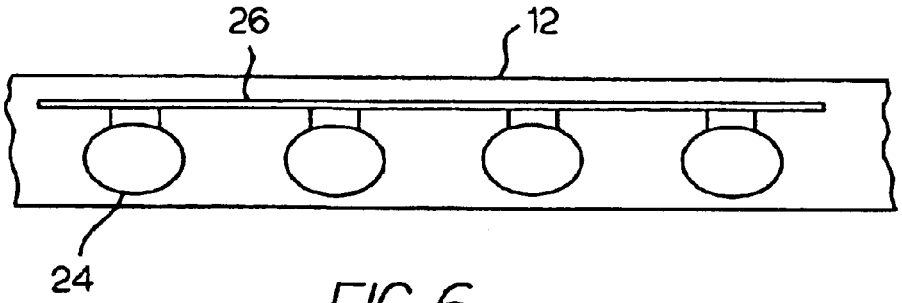

To further assist in the preferential diffusion and scattering of the light intensity pattern, applicant has further determined that the use of oval shaped LEDs 24 as shown in FIG. 6 are helpful. The best effect is obtained when the oval shaped LEDs 24 are positioned so that the major axis of the ellipse traced by the oval seen in top elevation view is directed along the long axis of the waveguide 12.

From the discussion above, it may now be appreciated that the illumination device of the present invention is rugged and resists breakage that normally would be expected for neon lighting counterparts in shipping and handling and is capable of being completely submerged in water and the like without any additional structural requirement. The illumination sources, preferably solid state lighting devices such as LEDs, uses far less electrical energy and remains relative cool to the touch. This allows the illumination device of the present invention to be used in places where the heat generated by neon lighting precludes its use, including locations requiring liquid submersion. Moreover, the light weight of the illumination device facilitates mounting on support structures that could not support the relative heavy weight of neon lighting and its required accessories. Finally, the illumination device is flexible in its use, allowing a tremendous variety of lighting techniques very difficult to obtain in neon lighting without substantial expense. Other advantages and uses of the present invention will be clearly obvious to those skilled in the art upon a reading of the disclosure herein and are intended to be covered by the scope of the claims set forth below.

What is claimed is:

1. An illumination device for simulating neon lighting comprising:

a substantially rod-like waveguide having a predetermined length with a lateral light receiving surface and a lateral curved light emitting surface having a predetermined circumferential width, said waveguide being comprised of a material that preferentially scatters light entering said light receiving surface such that a light intensity pattern exiting said light emitting surface has a major axis extending along said predetermined length;

an elongated light source extending along and positioned adjacent said light receiving surface and spaced from said light emitting surface a distance sufficient to cause said light intensity pattern to have a minor axis with a length extending substantially the entire circumferential width of said light emitting surface;

a housing positioned adjacent to said waveguide and defining a channel that receives said elongated light source and further serves to collect and direct light emitted by said light source into the light receiving surface of said waveguide;

a waterproof material substantially filling the channel defined by said housing, encompassing said light source and securing said light source in a position adjacent to said light receiving surface.

2. The illumination device of claim 1 in which said waterproof material is a potting compound having light transmitting characteristics.

3. The illumination device of claim 2 in which said elongated light source is a multiplicity of spaced point light sources arranged in a line extending substantially along said light receiving surface, said point light sources being spaced from one another a distance sufficient to cause the light intensity pattern of each light source to overlap and form a collective light intensity pattern that appears substantially uniform along said length of said light emitting surface.

4. The illumination device of claim 3 in which said point light sources are light emitting diodes.

5. The illumination device of claim 1, in which said housing has a pair of side walls each with an interior light reflecting surface and an exterior light absorbing surface.

6. The illumination device of claim 5, and further comprising:

an electric connecting member positioned within said housing and adapted to connect said light source to a remote power source, said waterproof material also encompassing said electric connecting member.

7. An illumination device for simulating neon lighting comprising:

a first light transmitting member of a predetermined length comprised of waveguide material and having a substantially curved front surface, said waveguide material preferentially scattering light entering a first lateral surface so that light emitted along the curved front surface has a light distribution pattern with a major axis extending along said predetermined length;

a housing adjacent said waveguide with spaced side walls abutting said first lateral surface and defining a volume, said side walls provided with a light reflecting interior surface and a light absorbing exterior surface;

a multiplicity of spaced point light sources housed within said volume and extending along said predetermined length, said spaced light sources positioned a distance from said front surface so as to minimize the viewing of localized regions of high light intensity within said light distribution pattern.

an electrical source connecting member positioned within said volume and connected to said point light sources; and a waterproof material encompassing said point light sources and securing said point light sources in a position adjacent to said first lateral surface.

8. The illumination device of claim 7 in which said waterproof material is a potting compound having light transmitting characteristics.

9. The illumination device of claim 7 in which said side walls are essentially parallel to each other and contain said waterproof material.

10. The illumination device of claim 7 in which said point light sources are LEDs.

* * * * *